United States Patent [19]

Barr

[11] Patent Number: 4,624,830

[45] Date of Patent: Nov. 25, 1986

[54] MANUFACTURE OF ROTARY DRILL BITS

[75] Inventor: John D. Barr, Cheltenham, England

[73] Assignee: NL Petroleum Products, Limited, Stonehouse, England

[21] Appl. No.: 676,697

[22] Filed: Nov. 30, 1984

[51] Int. Cl.[4] ..... B22F 7/00

[52] U.S. Cl. ..... 419/7; 164/97; 175/329; 175/409; 148/126.1; 148/127; 408/227; 419/9; 419/11; 419/18; 419/66; 428/552; 428/565; 428/908.8

[58] Field of Search ..... 419/11, 14, 66, 17, 419/18, 7, 8, 9; 164/97; 175/329, 409; 408/227; 148/126.1, 127; 428/552, 565, 908.8

[56] References Cited

U.S. PATENT DOCUMENTS

| | | | |
|---|---|---|---|
| 4,140,170 | 2/1979 | Baum | 164/97 |
| 4,172,395 | 10/1979 | Keller | 419/8 |
| 4,359,335 | 11/1982 | Garner | 419/18 |
| 4,398,952 | 8/1983 | Drake | 419/18 |
| 4,445,259 | 5/1984 | Ekbom | 419/8 |

*Primary Examiner*—Stephen J. Lechert, Jr.
*Attorney, Agent, or Firm*—William E. Johnson, Jr.

[57] ABSTRACT

A method of manufacturing by a powder metallurgy process a rotary drill bit including a bit body having a plurality of cutting elements mounted on the outer surface thereof comprises the steps of forming a hollow mould for moulding at least a portion of the bit body, packing the mould with powdered matrix material, and infiltrating the material with a metal alloy in a furnace to form a matrix. Before packing the mould with powdered matrix material, there are positioned in spaced locations on the interior surface of the mould a plurality of cutting elements, each of which is formed of a material, such as a polycrystalline diamond material, which is thermally stable at the temperature necessary to form the matrix. Also positioned in the mould, adjacent the rearward side of each cutting element, is a support material such that, at least after formation of the matrix, the support material has a higher modulus of elasticity than the matrix.

27 Claims, 19 Drawing Figures

FIG.3
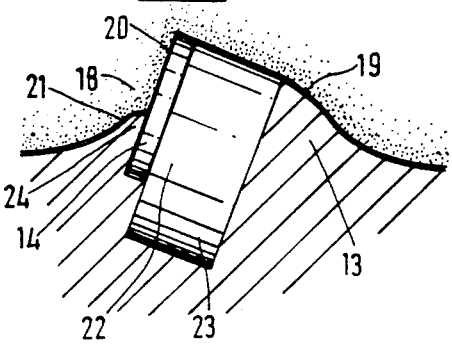
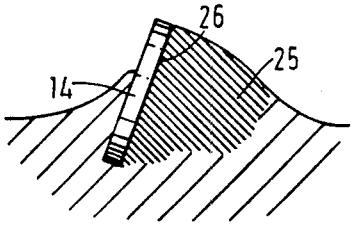
FIG.4
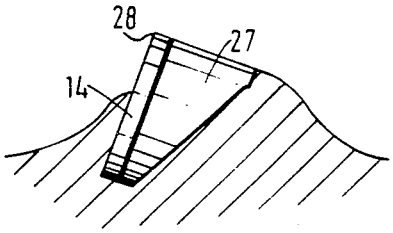
FIG.5
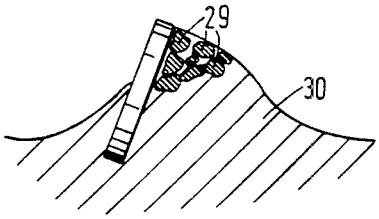
FIG.6
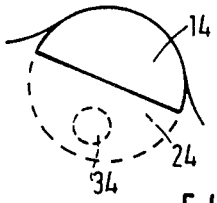
FIG.9
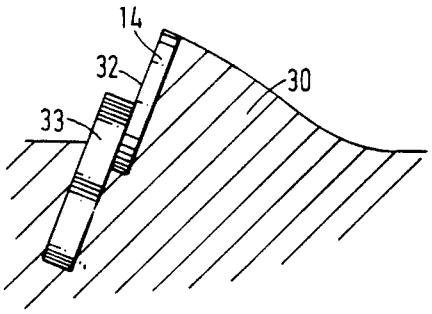
FIG.7
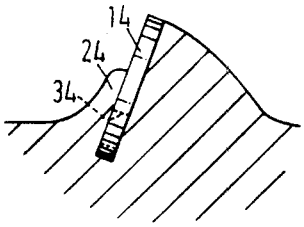
FIG.8

MANUFACTURE OF ROTARY DRILL BITS

BACKGROUND OF THE INVENTION

The invention relates to the manufacture of rotary drill bits for use in drilling or coring deep holes in subsurface formations.

In particular, the invention is applicable to rotary drill bits of the kind comprising a bit body having a shank and an inner channel for supplying drilling fluid to the face of the bit, and where the bit body carries a plurality of so-called "preform" cutting elements. Each cutting element is in the form of a tablet, usually circular, having a hard cutting face formed of polycrystalline diamond or other superhard material.

Conventionally, each cutting element is formed in two layers: a hard facing layer formed of polycrystalline diamond or other superhard material, and a backing layer formed of less hard material, such as cemented tungsten carbide. The two layer arrangement not only permits the use of a thin diamond layer, thus reducing the cost, but also provides a degree of self-sharpening since, in use, the less hard backing layer wears away more easily than the harder cutting layer.

In one commonly used method of making rotary drill bits of the above-mentioned type, the bit body is formed by a powder metallurgy process. In this process a hollow mould is first formed, for example from graphite, in the configuration of the bit body or a part thereof. The mould is packed with powdered material, such as tungsten carbide, which is then infiltrated with a metal alloy binder, such as copper alloy, in a furnace so as to form a hard matrix.

Where such method is used to make a drill bit using natural diamond cutting elements, the diamonds are conventionally located on the interior surface of the mould before it is packed with tungsten carbide, so that the diamonds become embedded in the matrix during the formation of the bit body. The maximum furnace temperature required to form the matrix may be of the order of 1050° to 1170° C., and natural diamonds can withstand such temperatures. Conventional preforms, however, are only thermally stable up to a temperature of 700° to 750° C. For this reason preform cutting elements are normally mounted on the bit body after it has been moulded, and the interior surface of the mould is suitably shaped to provide surfaces to which the cutting elements may be substantially hard soldered or brazed, or to provide sockets to receive studs or carriers to which the cutting elements are bonded.

This subsequent mounting of the cutting elements on the body is a time-consuming, difficult and costly process due to the nature of the materials involved, and, due to these difficulties, the mounting of some elements on the bit body is sometimes inadequate, giving rise to rapid fracture or detachment of the elements from the drill bit when in use. Furthermore, the mounting methods which have been developed, although generally effective, sometimes, for reasons of space, impose limitations on the positioning of the cutting elements on the bit body.

There are, however, now available polycrystalline diamond materials which are thermally stable up to the infiltration temperature, typically about 1100° C. Such a thermally stable diamond material is supplied by the General Electric Company under the trade name "GEOSET".

This material has been applied to rotary drill bits by setting pieces of the material in the surface of a bit body so as to project partly from the surface, using a similar method to that used for natural diamonds. The pieces have been, for example, in the form of a thick element of triangular shape, one apex of the triangle projecting from the surface of the drill bit and the general plane of the triangle extending either radially or tangentially. However, since such thermally stable elements do not have a backing layer to provide support, they are of substantially greater thickness, in the cutting direction, than conventional preforms in order to provide the necessary strength. This may significantly increase the cost of the cutting elements. Furthermore, the increase in thickness means that the cutting elements are no longer self-sharpening since the portion of the element behind the cutting face does not wear away faster than the cutting face itself, as is the case, as previously mentioned, with two-layer cutting elements.

It is therefore an object of the present invention to provide a method of manufacturing a rotary drill bit using thermally stable cutting elements, in which the above-mentioned disadvantages of such elements may be overcome.

SUMMARY OF THE INVENTION

According to the invention there is provided a method of manufacturing by a powder metallurgy process a rotary drill bit including a bit body having a plurality of cutting elements mounted on the outer surface thereof, the method being of the kind comprising the steps of forming a hollow mould for moulding at least a portion of the bit body, packing the mould with powdered matrix material, and infiltrating the material with a metal alloy in a furnace to form a matrix, the method of further comprising the steps, before packing the mould with powdered matrix material, of:

a. positioning in spaced locations on the interior surface of the mould a plurality of cutting elements, each of which is formed of a material which is thermally stable at the temperature necessary to form the matrix, and b. positioning adjacent the rearward side of each cutting element a support material such that, at least after formation of the matrix, the support material has a higher modulus of elasticity than that of the matrix.

The terms "frontward" and "rearward" relate to the direction of movement of the cutting element with respect to the formation being cut during normal operation of the drill bit.

There may be provided adjacent the frontward side of each cutting element means which, upon packing of the mould and formation of the matrix, provide a holding structure to hold the element in position on the bit body.

The method according to the invention takes advantage of the fact that the cutting elements are thermally stable by incorporating the elements in the bit body during the moulding process, rather than mounting the elements on the bit body after it has been formed, as has been the case hitherto with preform cutting elements.

By providing adjacent the rearward side of each cutting element a support material which, at least after formation of the matrix, has a higher modulus of elasticity than the matrix, there is provided a comparatively rigid support for the cutting element so as to reduce the risk of fracture of the cutting element which might otherwise occur due to the tendency of the material behind the cutting element to yield under the loads to which the cutting element is subjected during drilling. Such yielding of the material subjects the cutting element to bending stresses which it may not be able to sustain. The cutting element may thus be made thin enough to provide a self-sharpening effect, as well as reducing its cost.

Each cutting element may be formed of polycrystalline diamond material and may be in the form of a tablet, such as a circular disc, of such material, the opposite major faces of the tablet constituting said frontward and rearward sides thereof respectively.

The support material may comprise a single preformed solid insert, for example an insert formed of tungsten carbide or other hard material, and preferably has a surface thereof in abutting relationship to the rearward surface of the cutting element, the insert being so shaped as to be held in the finished bit body by the formation of matrix around the insert. Alternatively, the support may comprise a plurality of solid inserts, the matrix being formed between and around the inserts.

Alternatively, the support material may be applied to the mould in the form of a material, such as powdered matrix-forming material, which is converted to a hard material of higher modulus of elasticity than the matrix forming the rest of the bit body as a result of the process for forming the matrix. For example, the powdered material from which the matrix is formed may be applied to the mould as a compound, known as "wet mix", comprising the powdered material mixed with a hydrocarbon such as polyethylene glycol. The characteristics of the material may be varied, for example by varying the powder grain size distribution to vary the skeletal density and thus adjust the hardness of the resulting matrix. Accordingly, the support material for each cutting element may be provided in the form of a body of wet mix applied adjacent the rearward side of the cutting element before the rest of the mould is packed, the characteristics of the initial body of wet mix being such that the resulting matrix has a higher modulus of elasticity than the matrix forming the rest of the bit body.

In any of the arrangements described above including means for providing a holding structure to hold each cutting element in position on the bit body, said means may comprise a recess in the surface of the mould extending across part of the frontward surface of each cutting element, when said element is in position in the mould, which recess receives powdered material when the mould is packed and thus, when the matrix is formed, provides a holding portion integral with the matrix body and engaging the front face of the cutting element to hold it in position on the bit body.

Alternatively or additionally, the means providing a holding structure may comprise a separate, preformed element which is initially located in the mould in engagement with the frontward side of the cutting element in such manner that, after packing of the mould and formation of the matrix, the element is held by the matrix and, in turn, holds the cutting element in position on the bit body.

The preformed holding element may be an elongate element one end of which is embedded in the finished bit body and the opposite end of which extends partly across the frontward surface of the cutting element in contact therewith. The preformed element may be resiliently flexible.

Each cutting element may be formed with an aperture or recess into which engages a portion of the holding structure, whether the holding structure comprises the aforesaid holding portion integral with the matrix body or a separately formed element.

An an alternative or in addition to the methods according to the invention referred to above, the bending stresses imparted to each cutting element during drilling may also be reduced by an arrangement which provides a greater modulus of elasticity in the material behind the cutting edge than in material behind the rest of the element. This effect might, for example, be achieved by locating a lower modulus material behind portions of the element away from the cutting edge, or by locating a higher modulus material behind the cutting edge.

Accordingly, the invention also provides a method of manufacturing by a powder metallurgy process a rotary drill bit including a bit body having a plurality of cutting elements mounted on the outer surface thereof, the method being of the kind comprising the steps of forming a holow mould for moulding at least a portion of the bit body, packing the mould with powdered matrix material, and infiltrating the material with a metal alloy in a furnace to form a matrix, the method further comprising the steps, before packing the mould with powdered matrix material, of:

a. positioning in spaced locations on the interior surface of the mould a plurality of cutting elements, each of which is formed of a material which is thermally stable at the temperature necessary to form the matrix, and b. positioning adjacent the rearward side of each cutting element an insert such that, at least after formation of the matrix, the material adjacent the rear surface of the cutting element has a higher modulus of elasticity in the vicinity of the cutting edge of the element than it does away from that vicinity. This effect may be achieved, for example, by locating a higher modulus material in the vicinity of the cutting edge, or a lower modulus material away from that vicinity, or a combination thereof. ("Higher" or "lower" modulus in this context refer to comparison with the modulus of the normal matrix of the rest of the bit body). The insert may be a rigid preformed insert or a body of wet mix which is formed into a matrix as the main matrix is formed.

The invention includes within its scope a rotary drill bit manufactured by a method according to the invention and including any of the steps referred to above.

BRIEF DESCRIPTION OF THE DRAWINGS

FIG. 3 is a diagrammatic section through a cutting element of a rotary drill bit illustrating the method of manufacture according to the invention, FIGS. 4 to 8 are similar views through alternative mountings of cutting elements produced by the method according to the invention, FIG. 9 is a front elevation of the cutting element shown in FIG. 8, FIGS. 10 to 13 are similar views to FIGS. 3 to 8 of still further arrangements.

DETAILED DESCRIPTION OF PREFERRED EMBODIMENTS

Figure 1:
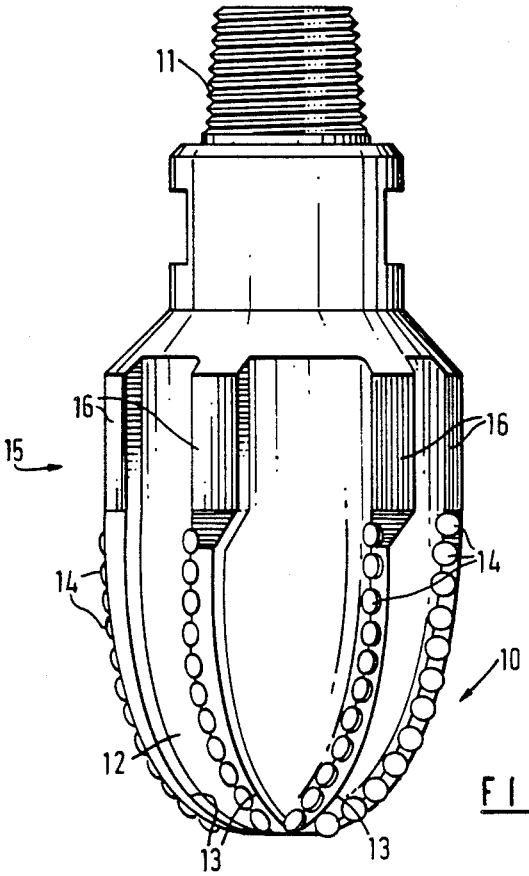
FIG. 1 is a side elevation of a typical drill bit of a kind to which the invention is particularly applicable.
Figure 2:
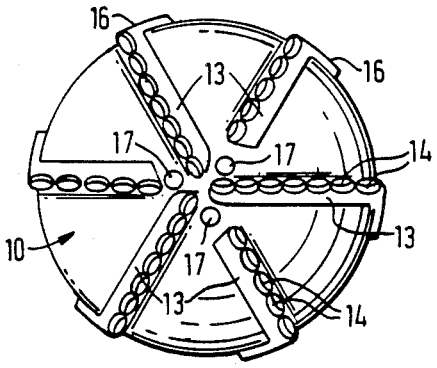
FIG. 2 is an end elevation of the drill bit shown in FIG. 1.

Referring to FIGS. 1 and 2, the rotary drill bit comprises a bit body 10 which is typically formed of tungsten carbide matrix infiltrated with a binder alloy, usually a copper alloy. There is provided a steel threaded shank 11 at one end of the bit body for connection to the drill string.

The operative end face 12 of the bit body is formed with a number of blades 13 radiating from the central area of the bit and the blades carry cutting elements 14 spaced apart along the length thereof.

The bit has a gauge section 15 including kickers 16 which contact the walls of the borehole to stabilise the bit in the borehole. A central channel (not shown) in the bit body and shank delivers drilling fluid through nozzles 17 in the end face 12 in known manner.

It will be appreciated that this is only one example of the many possible variations of the type of bit to which the invention is applicable.

The techniques of forming such bit bodies by powder metallurgy moulding processes are well known, as previously mentioned, and there will now be described modifications of the known methods by which thermally stable cutting elements are mounted on the bit body in the course of the moulding process, instead of the cutting elments being mounted on the bit body after moulding, as has previously been the case with preform cutting elements.

Referring to FIG. 3, a mould 18 is formed from graphite and has an internal configuration corresponding generally to the required surface shape of the bit body or a portion thereof. This is to say the mould 18 is formed with elongate recesses 19 corresponding to the blades 13. Spaced apart along each recess 19 are a plurality of part-circular recesses 20 each corresponding to the required location of a cutting element. A further recess 21 is provided in the surface of the mould 19 adjacent the recess 12.

Following construction of the mould, a plurality of thermally stable cutting elements 14 are secured within the recesses 20, as shown in FIG. 3, by means of a suitable adhesive. Within each recess 19, on the side of each cutting element 14 facing towards the interior of the mould, is located, again for example by use of an adhesive, a preformed rigid insert 22 formed for example from a material of high modulus of elasticity, such as cemented tungsten carbide.

The insert 22 may be of any suitable configuration but is preferably provided with a flat surface which extends over the whole area of the flat rearward surface of the cutting element 14. However, the insert 22 may extend further beyond the cutting element 14, as indicated at 23 in FIG. 3, or may extend over only part of the cutting element.

After all the cutting elements and inserts 22 are in position, the mould is packed with powdered tungsten carbide and infiltrated with a copper alloy binder in a furnace in conventional manner to form a matrix.

The matrix surrounds each cutting element 14 and rigid insert 22 and also fills each recess 21. The insert 22 is thus held firmly in the matrix body of the drill bit by being surrounded by the matrix material and the cutting element 14 is held firmly in position, being held between the insert 22 and a holding portion 24 formed by the matrix material which filled the recess 21. Thus the bit body is removed from the mould with the cutting elements all in the correct position and each cutting element firmly supported by an insert of material of high modulus of elasticity.

The extension 23 of the insert 22 provides an additional portion thereof to be held by the matrix and the insert may be formed with undercuts or recesses into which the moulding material enters so as to key the insert into the matrix.

The surface of the insert 22 may be in close abutting relation to the rear surface of the cutting element 14. Any space between the insert and cutting element will, however, fill with the copper alloy binder or infiltrant as the matrix is formed. Any space between the insert and cutting element may, for example, be due to irregularity in the surface of either component but in some cases it may be advantageous deliberately to provide a narrow gap between the surfaces, to be filled by matrix or by the binder or infiltrant.

Depending on the material of the cutting element and the composition of the matrix-forming material, the rear surface of the cutting element may or may not become bonded to the matrix during its formation. In either case the holding of the cutting element to the bit body may be improved by suitable shaping of the element, for example by providing it with a peripheral bevel which the matrix overlies. As previously mentioned, the powdered matrix-forming material may be packed into the mould in the form of a compound known as "wet mix", comprising tungsten carbide powder mixed with polyethylene glycol. Once the mould has been packed it is heated in a furnace to burn off the polyethylene glycol whereafter the material is infiltrated with the copper alloy binder or infiltrant. Instead of being a preformed rigid insert, the support for the cutting element 14 may, as shown in FIG. 4, be in the form of a body 25 of wet mix applied to the mould behind the rearward face 26 of the cutting element 14 prior to packing the mould. In the process of forming the matrix in the furnace the matrix formed behind the cutting element 14 is, due to the characteristics of the wet mix used, of greater skeletal density and of higher modulus of elasticity than the matrix in the main body of the drill bit, and therefore provides a support for the cutting element.

FIG. 5 shows a preformed rigid insert 27, formed for example from tungsten carbide, which is generally wedge-shaped in section so as to be of greater thickness behind the cutting edge 28 of the cutting element 14, this being the portion of the cutting element which is most subjected to stress during drilling.

In the arrangement of FIG. 6 the insert is in the form of a number of comparatively large agglomerates 29 of tungsten carbide or similar hard material, the matrix 30 surrounding, enclosing and holding the particles 29.

Instead of the holding structure on the frontward side of the cutting element comprising an integral extension of the matrix body, it may comprise a separately preformed holding element which is located in the mould adjacent the front surface of the cutting element 14. For example, as shown in FIG. 7, the holding element may be in the form of an elongate bar 33 which is so located in the mould that, when the matrix has been formed, part of the bar 33 is embedded in the matrix body 30 and part of it projects from the matrix body and across the front face 32 of the cutting element.

In the arrangement of FIG. 8 the cutting element 14 is preformed with a hole 34 which fills with matrix and thus positively holds the cutting element to the bit body. A similar holding effect may be provided by forming the cutting element with one or more recesses in the surface thereof.

Although the cutting elements have been described above as being circular tablets, other forms of cutting element are possible.

The purpose of the insert on the rearward side of each cutting element is, as previously mentioned, to reduce the risk of fracture of the cutting element due to bending stresses being imparted to it during drilling, as a result of yielding of the material on the rearward side of the cutting element. Although the risk of fracture is thus reduced by the more rigid inserts having less tendency to yield than matrix, any liability to bending stresses may be further reduced by reducing the restraint applied to the cutting element by its holding structure engaging the front face thereof so that, in effect, the cutting element may tilt bodily upon any yielding of the support insert, thus reducing the bending stress applied to the cutting element.

Figure 10:
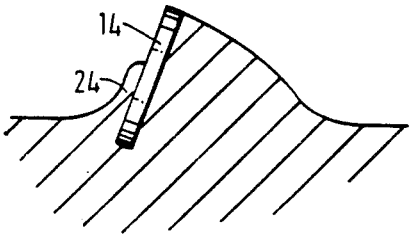
Figure 11:
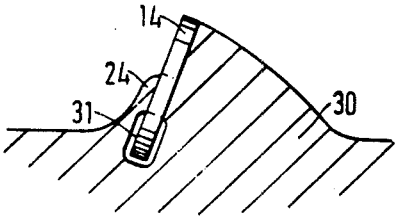

This effect may be provided, for example, by arranging for the extension 24 of the matrix body to be thin in cross-section as shown in FIG. 10 or by arranging for the extension to engage only the central portion of the cutting element 14 as shown in FIG. 11, the radially inner edge of the cutting element 14 being located within a recess or body of low modulus material 31 in the matrix 30.

Figure 12:
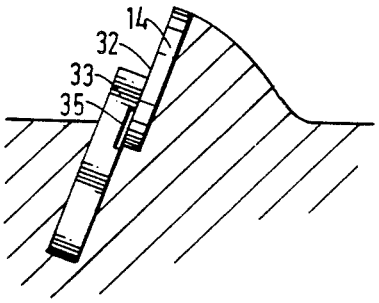

FIG. 12 shows an arrangement for reducing the bending stresses on the cutting element 14 by providing a recess 35 in the elongate holding element 33 so that the holding element engages only the central portion of the frontward surface 32 of the cutting element 14.

Figure 13:
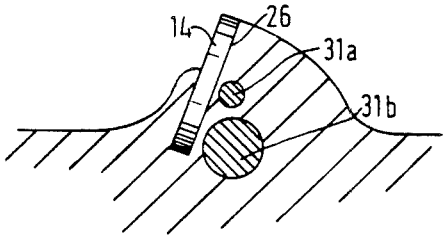

In the arrangements of FIGS. 7 to 12 the support insert is not shown, but may take any of the forms previously described and within the scope of the invention.

instead of locating a high modulus insert adjacent the cutting edge of the cutting element, a similar effect, i.e. a reduction in bending stress under load, may be achieved by locating a low modulus insert adjacent and to the rear of the opposite edge portion of the cutting element. Such an arrangement is shown in FIG. 13 where spheres or cylinders 31*a* and 31*b* of material of low modulus of elasticity are located rearwardly of the radially inner portion of the element. During cutting, if there is any deflection of the cutting element due to yielding of matrix behind the cutting edge, the low modulus of the inserts will permit the element to tilt bodily, thus reducing the bending stresses imparted to it. Although the insert 31*a* will be subjected to compressive stress, the insert 31*b* will probably be subjected to tensile stress and will thus only serve any purpose if the rear surface of the cutting element is bonded to the supporting matrix. The low modulus inserts may be formed from a wet mix which gives a lower modulus matrix than the mix used for the rest of the bit body.

In any arrangement where the cutting element is not flat, it is particularly suitable for the support for the cutting element to be provided by wet mix of a hard composition and the holding structure on the front face of the cutting element to be provided by an integral extension of the main matrix since both these components may then automatically conform to the contour of the cutting element no matter what the contour may be.

As previously mentioned, in any of the arrangements described above, the retention of the cutting element in the matrix may be improved by providing the cutting element with a peripheral bevel which the matrix overlies. FIGS. 14 to 19 show examples of cutting elements of this kind.

Figure 14:
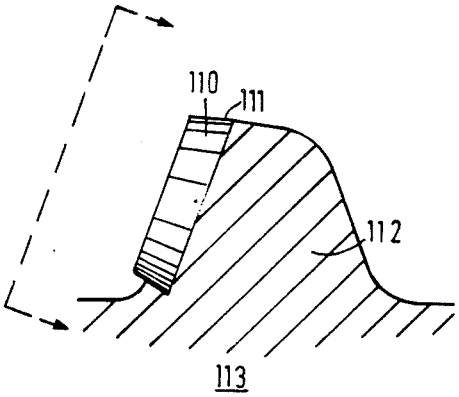
FIGS. 14 to 19 illustrate cutting elements which are bevelled to assist in their retention in the bit body.
Figure 15:
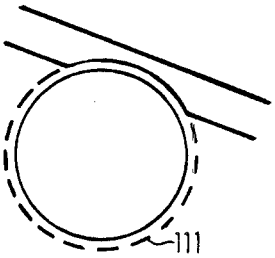

In the arrangement of FIGS. 14 and 15, the cutting element 110 comprises a circular disc of thermally stable polycrystalline diamond material, formed with a peripheral bevel 111.

A plurality of such cutting elements are mounted along the length of a blade 112 projecting from the surface of the bit body 113, such blades normally extending outwardly away from the central axis of the bit towards the outer periphery thereof.

The cutting elements 110 are mounted on the bit body, as previously described, by being located on the interior surface of the mould for forming the bit body before the mould is packed with tungsten carbide, so that the cutting elements become embedded in the matrix during the formation of the bit body. Using the cutting elements of the kind shown in FIG. 14, the recesses in the mould which locate the cutting elements are so shaped that the matrix material may flow over and around the peripheral bevel 111 around a major portion of the periphery of the cutting element and thus serve to assist in holding the cutting element in position on the blade 112.

FIGS. 14 and 15 are for the purpose only of illustrating diagrammatically the shape of the cutting element and it will be appreciated that the cutting element may be further held and/or supported by any of the methods described above in relation to FIGS. 1 to 13.

Figure 16:
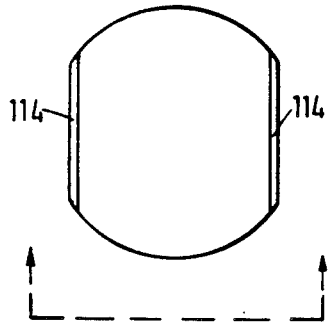
Figure 17:
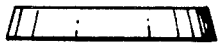

FIGS. 16 and 17 show an alternative shape of cutting element where two segments are removed from opposed portions of the cutting element so as to provide two straight parallel bevels 114 which become embedded in the matrix material.

Figure 19:
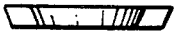
Figure 18:
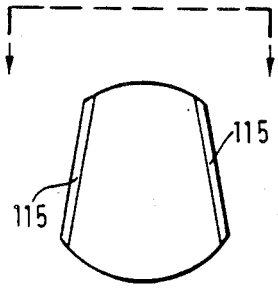

FIGS. 18 and 19 show an alternative form of cutting element in which convergent opposed straight bevelled portions 115 are provided. It will be appreciated that if the cutting edge of the cutting element is the narrower end thereof the convergence of the bevels will oppose any tendency for the cutting element to be pulled out of the matrix by the cutting forces.

The bevels may be formed by any conventional method. For example, thermally stable polycrystalline diamond cutting elements are manufactured by initially binding the polycrystalline diamond particles together with a binder which is subsequently leeched out. The cutting of the bevels may be effected by spark erosion before such leeching is effected.

Although the invention has been described in relation to single layer cutting elements of polycrystalline diamond, this is merely because this is the only type of thermally stable preform cutting element which is currently available. The present invention relates to methods of supporting and holding the preform in the bit body rather than to the particular material of the preform and thus includes within its scope methods of the kinds described when used with other types of thermally stable cutting elements which may be developed, including two-layer or multi-layer preforms and those where the superhard material is material other than polycrystalline diamond.

The arrangements described above provide for the cutting elements to be held in position on the bit body by having portions of the matrix, or other elements, overlying portions of the cutting elements, although reference has also been made to the possibility of the cutting elements being, in addition, bonded to the bit body. It will be appreciated, however, that if the bonding of the cutting elements to the bit body is sufficiently strong, such bonding may comprise the major, or sole means for securing the cutting elements to the bit body.

I claim:

1. A method of manufacturing by a powder metallurgy process a rotary drill bit including a bit body having a plurality of cutting elements mounted on the outer surface thereof, the method comprising the steps of:

a. forming a hollow mould for moulding at least a portion of the bit body;
b. positioning in spaced locations on the interior surface of the mould a plurality of cutting elements;
c. positioning a support material adjacent the rearward side of each cutting element;
d. packing the mould with powdered matrix material;
e. providing a metal alloy in contact with the powdered matrix material in the mould;
f. heating the packed mould in a furnace to an infiltration temperature at which the metal alloy fuses and infiltrates the powdered matrix material; and
g. cooling the mould to solidify the infiltrated matrix;
h. each cutting element being formed of a material which is thermally stable at said infiltration temperature; and
i. the support material, at least after formation of the solid infiltrated matrix, having a higher modulus of elasticity than that of the solid infiltrated matrix.

2. A method according to claim 1, wherein there is provided adjacent the frontward side of each cutting element means which, upon packing of the mould and formation of the solid infiltrated matrix, provide a holding structure to hold the element in position on the bit body.

3. A method according to claim 1, wherein each cutting element is formed of polycrystalline diamond material and is in the form of a tablet of such material, the opposite major faces of the tablet constituting said frontward and rearward sides thereof respectively.

4. A method according to claim 3, wherein each cutting element is in the form of a circular disc.

5. A method according to claim 1, wherein the support material comprises a single preformed solid insert, the insert being so shaped as to be held in the finished bit body by the formation of solid infiltrated matrix around the insert.

6. A method according to claim 1, wherein the support comprises a plurality of solid inserts, the solid infiltrated matrix being formed between and around the inserts.

7. A method according to claim 5, wherein the insert has a surface thereof in abutting relationship to the rearward surface of the cutting element.

8. A method according to claim 5, wherein the insert is formed of tungsten carbide.

9. A method according to claim 1, wherein the support material is applied to the mould in the form of a material which is converted to a hard material of higher modulus of elasticity than the solid infiltrated matrix forming the rest of the bit body as a result of the process for forming the solid infiltrated matrix.

10. A method according to claim 9, wherein the support material is applied to the mould in the form of a powdered matrix-forming material.

11. A method according to claim 10, wherein the powdered matrix-forming material is applied to the mould as a compound comprising the powdered material mixed with a liquid to form a paste.

12. A method according to claim 11, wherein the liquid is a hydrocarbon.

13. A method according to claim 1, including the step of providing a holding structure to hold each cutting element in position on the bit body.

14. A method according to claim 13, including forming a recess in the surface of the mould extending across part of the frontward surface of each cutting element, when said element is in position in the mould, which recess receives powdered material when the mould is packed and thus, when the solid infiltrated matrix is formed, provides a holding portion integral with the solid infiltrated matrix body and engaging the front face of the cutting element to hold it in position on the bit body.

15. A method according to claim 13, including providing a preformed element which is initially located in the mould in engagement with the frontward side of each cutting element in such manner that, after packing of the mould and formation of the solid infiltrated matrix, the element is held by the matrix and, in turn, holds the cutting element in position on the bit body.

16. A method according to claim 15, wherein the preformed holding element is an elongate element one end of which is embedded in the finished bit body and the opposite end of which extends partly across the frontward surface of the cutting element in contact therewith.

17. A method according to claim 16, wherein the preformed element is resiliently flexible.

18. A method according to claim 13, wherein each cutting element is formed with a recess, into which engages a portion of the holding structure.

19. A method according to claim 1, wherein each cutting element is formed, around at least a portion of the periphery thereof, with a portion or reduced thickness, the portion of reduced thickness being so disposed as to become at least partly embedded in the solid infiltrated matrix material so as to hold, or assist in holding the cutting element on the bit body.

20. A method of manufacturing by a powder metallurgy process a rotary drill bit including a bit body having a plurality of cutting elements mounted on the outer surface thereof, the method comprising the steps of:

a. forming a hollow mould for moulding at least a portion of the bit body;
b. positioning in spaced locations on the interior surface of the mould a plurality of cutting elements;
c. positioning an insert adjacent the rearward side of each cutting element;
d. packing the mould with powdered matrix material;
e. providing a metal alloy in contact with the powdered matrix material in the mould;
f. heating the packed mould in a furnace to an infiltration temperature at which the metal alloy fuses and infiltrates the powdered matrix material; and
g. cooling the mould to solidify the infiltrated matrix;
h. each cutting element being formed of a material which is thermally stable at said infiltration temperature; and
i. The insert being such that, at least after formation of the solid infiltrated matrix, material adjacent the rear surface of the cutting element has a higher modulus of elasticity in the vicinity of the cutting edge of the element than it does away from the vicinity.

21. A method according to claim 20, wherein the insert is of higher modulus of elasticity than the solid infiltrated matrix forming the rest of the bit body, and is located on the rearward side of the cutting element in the vicinity of the cutting edge thereof.

22. A method according to claim 20, wherein the insert is of a lower modulus of elasticity than the solid infiltrated matrix forming the rest of the bit body, and is located on the rearward side of the cutting element away from the vicinity of the cutting edge thereof.

23. A method according to claim 21, wherein the insert comprises at least one preformed solid element, so shaped as to be held in the finished bit body by the formation of solid infiltrated matrix around the insert.

24. A method according to claim 21, wherein the insert is applied to the mould in the form of a material which is converted to a hard material of the required modulus of elasticity as a result of the process of forming the solid infiltrated matrix.

25. A method according to claim 19, wherein the portion of reduced thickness comprises a peripheral bevel on the cutting element.

26. A method according to claim 25, wherein the peripheral bevel extends around the entire circumference of the cutting element.

27. A method according to claim 25, wherein the cutting element is formed with two substantially straight bevelled portions at opposite side edges thereof.

* * * * *